US011085294B2

(12) United States Patent
Dai et al.

(10) Patent No.: US 11,085,294 B2
(45) Date of Patent: Aug. 10, 2021

(54) MUD FILTRATE PROPERTY MEASUREMENT FOR DOWNHOLE CONTAMINATION ASSESSMENT

(71) Applicant: Halliburton Energy Services, Inc., Houston, TX (US)

(72) Inventors: Bin Dai, Spring, TX (US); Christopher Michael Jones, Katy, TX (US); Michael Thomas Pelletier, Houston, TX (US); Darren George Gascooke, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 62 days.

(21) Appl. No.: 16/609,407

(22) PCT Filed: Nov. 30, 2018

(86) PCT No.: PCT/US2018/063247
§ 371 (c)(1),
(2) Date: Oct. 29, 2019

(87) PCT Pub. No.: WO2020/112131
PCT Pub. Date: Jun. 4, 2020

(65) Prior Publication Data
US 2021/0054737 A1 Feb. 25, 2021

(51) Int. Cl.
*E21B 49/08* (2006.01)
*E21B 49/10* (2006.01)
*E21B 47/12* (2012.01)

(52) U.S. Cl.
CPC ..... *E21B 49/081* (2013.01); *E21B 47/12* (2013.01); *E21B 49/10* (2013.01)

(58) Field of Classification Search
CPC .. E21B 49/081; E21B 49/087; E21B 49/0875; E21B 49/10
See application file for complete search history.

(56) References Cited

U.S. PATENT DOCUMENTS 3,611,799 A * 10/1971 Davis ..... E21B 49/10 73/152.24
7,128,144 B2 * 10/2006 Fox ..... E21B 49/10 166/100

(Continued)

FOREIGN PATENT DOCUMENTS

WO WO-2010120285 A1 * 10/2010 ..... E21B 49/081
WO WO-2012103069 A2 * 8/2012 ..... E21B 49/087

(Continued)

OTHER PUBLICATIONS

ISRWO International Search Report and Written Opinion for PCT/US2018/063247 dated Aug. 16, 2019.

*Primary Examiner* — Jennifer H Gay
(74) *Attorney, Agent, or Firm* — John Wustenberg; C. Tumey Law Group PLLC

(57) ABSTRACT

A method and system for measuring drilling fluid filtrate. The method may comprise disposing a downhole fluid sampling tool into a wellbore at a first location, activating a pump to draw a solids-containing fluid disposed in the wellbore into the downhole fluid sampling tool, drawing the drilling fluid with the pump across the at least one filter to form a drilling fluid filtrate, drawing the drilling fluid filtrate with the pump through the channel to the at least one sensor section, and measuring the drilling fluid filtrate with the at least one sensor. A system may comprise a downhole fluid sampling tool. The downhole fluid sampling tool may comprise at least one multi-chamber section, at least one sensor section, at least one filter, a pump, and a channel.

20 Claims, 9 Drawing Sheets

(56) References Cited

U.S. PATENT DOCUMENTS 7,650,937 B2 * 1/2010 Fox ..... E21B 49/10 166/264
7,997,341 B2 * 8/2011 Briquet ..... E21B 49/10 166/264
8,215,388 B2 * 7/2012 van Zuilekom ..... E21B 43/38 166/264
8,235,106 B2 * 8/2012 Fox ..... E21B 49/10 166/100
8,276,662 B2 * 10/2012 Niconoff ..... E21B 43/08 166/264
8,511,379 B2 * 8/2013 Spross ..... E21B 49/10 166/264
8,522,870 B2 * 9/2013 Fox ..... E21B 49/10 166/264
8,762,063 B2 * 6/2014 Zhang ..... E21B 47/113 702/6
9,182,518 B2 * 11/2015 Pelletier ..... G01N 33/2823
9,249,659 B2 * 2/2016 Pelletier ..... E21B 49/081
9,284,836 B2 * 3/2016 Rodney ..... E21B 49/08
10,180,064 B2 * 1/2019 Feng ..... E21B 34/066
10,221,686 B2 * 3/2019 Jones ..... E21B 49/00
10,261,005 B2 * 4/2019 Xia ..... G01N 9/002
10,280,745 B2 * 5/2019 Eyuboglu ..... E21B 49/08
10,294,783 B2 * 5/2019 Jones ..... E21B 49/08
10,415,381 B2 * 9/2019 Samec ..... E21B 49/10
10,648,328 B2 * 5/2020 Pelletier ..... E21B 47/06
10,927,674 B2 * 2/2021 Chen ..... E21B 49/10
2004/0094483 A1 5/2004 Mueller
2004/0173351 A1 * 9/2004 Fox ..... E21B 49/10 166/264
2005/0205256 A1 * 9/2005 DiFoggio ..... E21B 49/08 166/250.16
2007/0039731 A1 * 2/2007 Fox ..... E21B 49/10 166/264
2008/0314139 A1 * 12/2008 DiFoggio ..... E21B 47/10 73/152.55
2010/0089569 A1 * 4/2010 van Zuilekom ..... E21B 43/38 166/250.01
2010/0116494 A1 * 5/2010 Fox ..... E21B 49/10 166/264
2010/0193187 A1 * 8/2010 Briquet ..... E21B 49/081 166/264
2010/0236776 A1 * 9/2010 Spross ..... E21B 49/08 166/250.02
2011/0011583 A1 * 1/2011 Niconoff ..... E21B 43/08 166/264
2011/0139448 A1 * 6/2011 Ciglenec ..... E21B 49/10 166/264
2012/0292024 A1 * 11/2012 Fox ..... E21B 49/10 166/264
2013/0046473 A1 * 2/2013 Zhang ..... E21B 47/113 702/6
2013/0220595 A1 * 8/2013 Briquet ..... E21B 49/10 166/168
2013/0311099 A1 * 11/2013 Eyuboglu ..... E21B 49/08 702/11
2014/0060821 A1 * 3/2014 Rodney ..... E21B 49/08 166/250.12
2015/0007631 A1 * 1/2015 Pelletier ..... E21B 49/10 73/1.02
2015/0226060 A1 * 8/2015 Jones ..... E21B 49/08 73/152.23
2016/0215617 A1 * 7/2016 Samec ..... E21B 49/10
2016/0362977 A1 * 12/2016 Feng ..... E21B 49/10
2017/0067338 A1 * 3/2017 Gisolf ..... E21B 49/081
2017/0067809 A1 * 3/2017 Xia ..... G01N 11/167
2017/0254735 A1 9/2017 Shen et al.
2019/0257201 A1 * 8/2019 Chen ..... C09K 8/50
2019/0390548 A1 * 12/2019 Samec ..... G01N 33/287
2020/0003053 A1 * 1/2020 Pelletier ..... G01N 25/00
2020/0318477 A1 * 10/2020 Pfeiffer ..... E21B 49/08
2020/0400017 A1 * 12/2020 Olapade ..... E21B 49/10
2020/0400858 A1 * 12/2020 Olapade ..... G01N 30/8675
2021/0047924 A1 * 2/2021 Kallehbasti ..... G01N 21/94
2021/0054737 A1 * 2/2021 Dai ..... E21B 47/12

FOREIGN PATENT DOCUMENTS

WO WO-2013115803 A1 * 8/2013 ..... G01N 33/2823
WO 2018125100 7/2018
WO WO-2018144606 A1 * 8/2018 ..... G01N 21/94

* cited by examiner

MUD FILTRATE PROPERTY MEASUREMENT FOR DOWNHOLE CONTAMINATION ASSESSMENT

BACKGROUND

During oil and gas exploration, many types of information may be collected and analyzed. The information may be used to determine the quantity and quality of hydrocarbons in a reservoir and to develop or modify strategies for hydrocarbon production. For instance, the information may be used for reservoir evaluation, flow assurance, reservoir stimulation, facility enhancement, production enhancement strategies, and reserve estimation. One technique for collecting relevant information involves obtaining and analyzing fluid samples from a reservoir of interest. There are a variety of different tools that may be used to obtain the fluid sample. The fluid sample may then be analyzed to determine fluid properties, including, without limitation, component concentrations, plus fraction molecular weight, gas-oil ratios, bubble point, dew point, phase envelope, viscosity, combinations thereof, or the like. Conventional analysis has required transfer of the fluid samples to a laboratory for analysis. Downhole analysis of the fluid sample may also be used to provide real-time fluid properties, thus avoiding delays associated with laboratory analysis.

Accurate determination of fluid properties may be problematic as the fluid sample may often be contaminated with drilling fluids. Fluid samples with levels of drilling fluid contamination may result in non-representative fluids and measured properties. Techniques to determine drilling fluid contamination may include use of pump-out curves, such as density, gas-to-oil ratio and resistivity, among other properties of the fluids. However, determination of drilling fluid contamination using these techniques may be limited, for example, due to lack of significant decrease of the property value, non-linear behavior or properties to contamination levels, and unreliable property measurements. To reduce drilling fluid contamination, longer pump-out time may be required, which may lead to loss of rig time and increase risk of stuck tools, among other problems.

BRIEF DESCRIPTION OF THE DRAWINGS

These drawings illustrate certain aspects of some of the embodiments of the present invention, and should not be used to limit or define the invention.

DETAILED DESCRIPTION

Down hole sampling is a downhole operation that is used for formation evaluation, asset decisions, and operational decisions. Pure filtrate readings are important to be understood during sampling operations. Pure mud filtrate properties are currently assumed or estimated in order to derive sample contamination. When the fluid properties of the filtrate are significantly different from the formation fluid, then errors in the assumptions, or estimations, do not adversely affect the analysis, however, the closer the fluid properties, the greater the negative effect on contamination assessment. Currently a measurement of pure filtrate readings is hampered by length of time it takes to remove particles from the inlet flow line, such that by the time the particles clear, the sample is no longer pure filtrate. Extrapolation of readings to initial fluid composition as a function of time, or volume or dependent variable therein, (e.g., pure filtrate is practiced), but with great uncertainty. The current method and apparatus is presented to acquire pure filtrate measurements within the petroleum well proximate to the sampling location relative to the surface.

Figure 1:
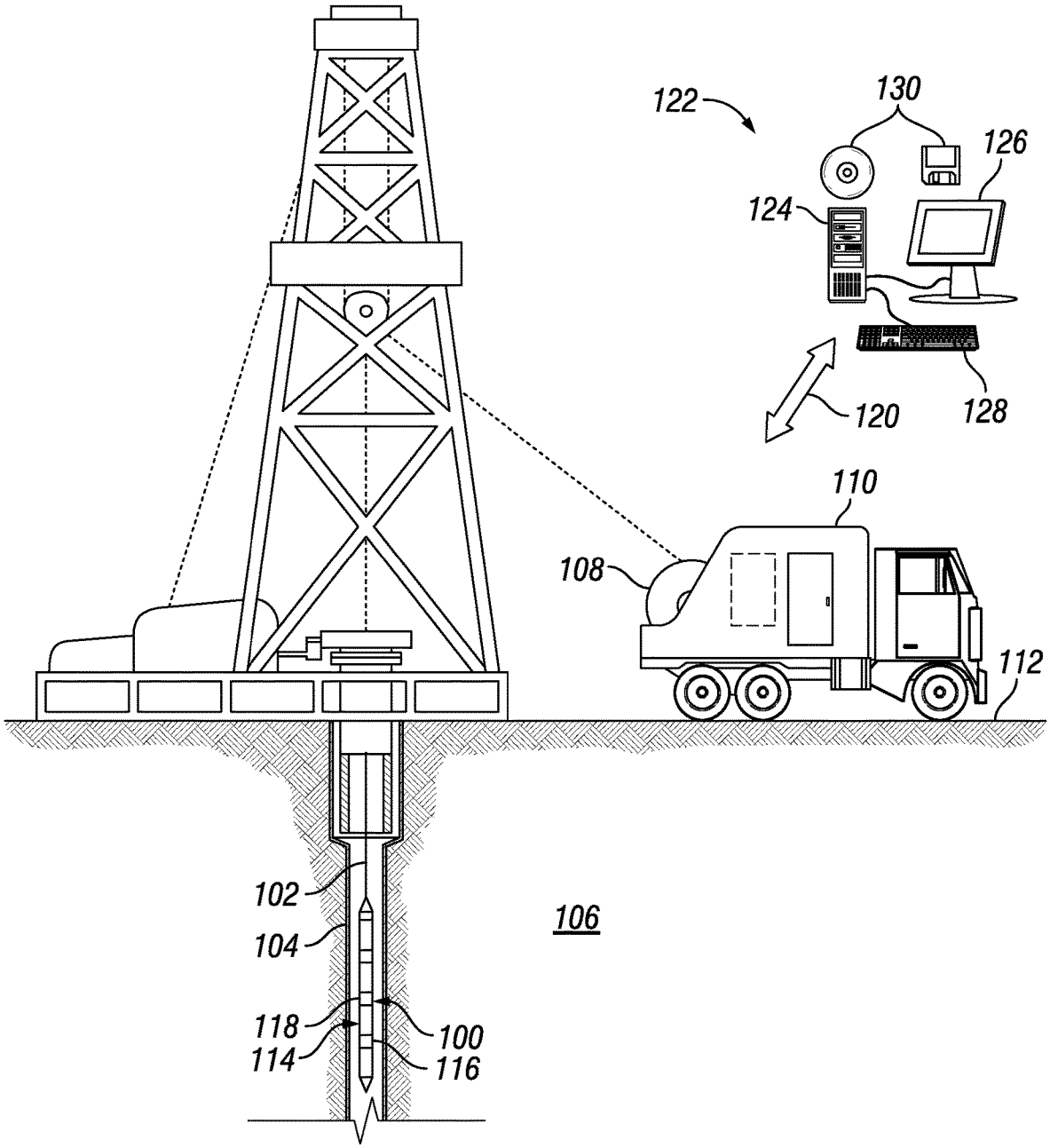
FIG. 1 is a schematic diagram of an example downhole fluid sampling tool on a wireline.

FIG. 1, is a schematic diagram is shown of downhole fluid sampling tool 100 on a conveyance 102. As illustrated, wellbore 104 may extend through subterranean formation 106. In examples, reservoir fluid may be contaminated with well fluid (e.g., drilling fluid) from wellbore 104. As described herein, the fluid sample may be analyzed to determine fluid contamination and other fluid properties of the reservoir fluid. As illustrated, a wellbore 104 may extend through subterranean formation 106. While the wellbore 104 is shown extending generally vertically into the subterranean formation 106, the principles described herein are also applicable to wellbores that extend at an angle through the subterranean formation 106, such as horizontal and slanted wellbores. For example, although FIG. 1 shows a vertical or low inclination angle well, high inclination angle or horizontal placement of the well and equipment is also possible. It should further be noted that while FIG. 1 generally depicts a land-based operation, those skilled in the art will readily recognize that the principles described herein are equally applicable to subsea operations that employ floating or sea-based platforms and rigs, without departing from the scope of the disclosure.

As illustrated, a hoist 108 may be used to run downhole fluid sampling tool 100 into wellbore 104. Hoist 108 may be disposed on a vehicle 110. Hoist 108 may be used, for example, to raise and lower conveyance 102 in wellbore 104. While hoist 108 is shown on vehicle 110, it should be understood that conveyance 102 may alternatively be disposed from a hoist 108 that is installed at surface 112 instead of being located on vehicle 110. Downhole fluid sampling tool 100 may be suspended in wellbore 104 on conveyance 102. Other conveyance types may be used for conveying downhole fluid sampling tool 100 into wellbore 104, including coiled tubing and wired drill pipe, for example. Downhole fluid sampling tool 100 may comprise a tool body 114, which may be elongated as shown on FIG. 1. Tool body 114 may be any suitable material, including without limitation titanium, stainless steel, alloys, plastic, combinations thereof, and the like. Downhole fluid sampling tool 100 may further include one or more sensors 116 for measuring properties of the fluid sample, reservoir fluid, wellbore 104, subterranean formation 106, or the like. In examples, downhole fluid sampling tool 100 may also include a fluid analysis module 118, which may be operable to process information regarding fluid sample, as described below. The downhole fluid sampling tool 100 may be used to collect fluid samples from subterranean formation 106 and may obtain and separately store different fluid samples from subterranean formation 106.

In examples, fluid analysis module 118 may comprise at least one a sensor that may continuously monitor a reservoir fluid. Such sensors include optical sensors, acoustic sensors, electromagnetic sensors, conductivity sensors, resistivity sensors, selective electrodes, density sensors, mass sensors, thermal sensors, chromatography sensors, viscosity sensors, bubble point sensors, fluid compressibility sensors, flow rate sensors. Sensors may measure a contrast between drilling fluid filtrate properties and formation fluid properties. Fluid analysis module 118 may be operable to derive properties and characterize the fluid sample. By way of example, fluid analysis module 118 may measure absorption, transmittance, or reflectance spectra and translate such measurements into component concentrations of the fluid sample, which may be lumped component concentrations, as described above. The fluid analysis module 118 may also measure gas-to-oil ratio, fluid composition, water cut, live fluid density, live fluid viscosity, formation pressure, and formation temperature. Fluid analysis module 118 may also be operable to determine fluid contamination of the fluid sample and may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, fluid analysis module 118 may include random access memory (RAM), one or more processing units, such as a central processing unit (CPU), or hardware or software control logic, ROM, and/or other types of nonvolatile memory.

Any suitable technique may be used for transmitting signals from the downhole fluid sampling tool 100 to the surface 112. As illustrated, a communication link 120 (which may be wired or wireless, for example) may be provided that may transmit data from downhole fluid sampling tool 100 to an information handling system 122 at surface 112. Information handling system 122 may include a processing unit 124, a monitor 126, an input device 128 (e.g., keyboard, mouse, etc.), and/or computer media 130 (e.g., optical disks, magnetic disks) that can store code representative of the methods described herein. The information handling system 122 may act as a data acquisition system and possibly a data processing system that analyzes information from downhole fluid sampling tool 100. For example, information handling system 122 may process the information from downhole fluid sampling tool 100 for determination of fluid contamination. The information handling system 122 may also determine additional properties of the fluid sample (or reservoir fluid), such as component concentrations, pressure-volume-temperature properties (e.g., bubble point, phase envelop prediction, etc.) based on the fluid characterization. This processing may occur at surface 112 in real-time. Alternatively, the processing may occur downhole hole or at surface 112 or another location after recovery of downhole fluid sampling tool 100 from wellbore 104. Alternatively, the processing may be performed by an information handling system in wellbore 104, such as fluid analysis module 118. The resultant fluid contamination and fluid properties may then be transmitted to surface 112, for example, in real-time.

Figure 2:
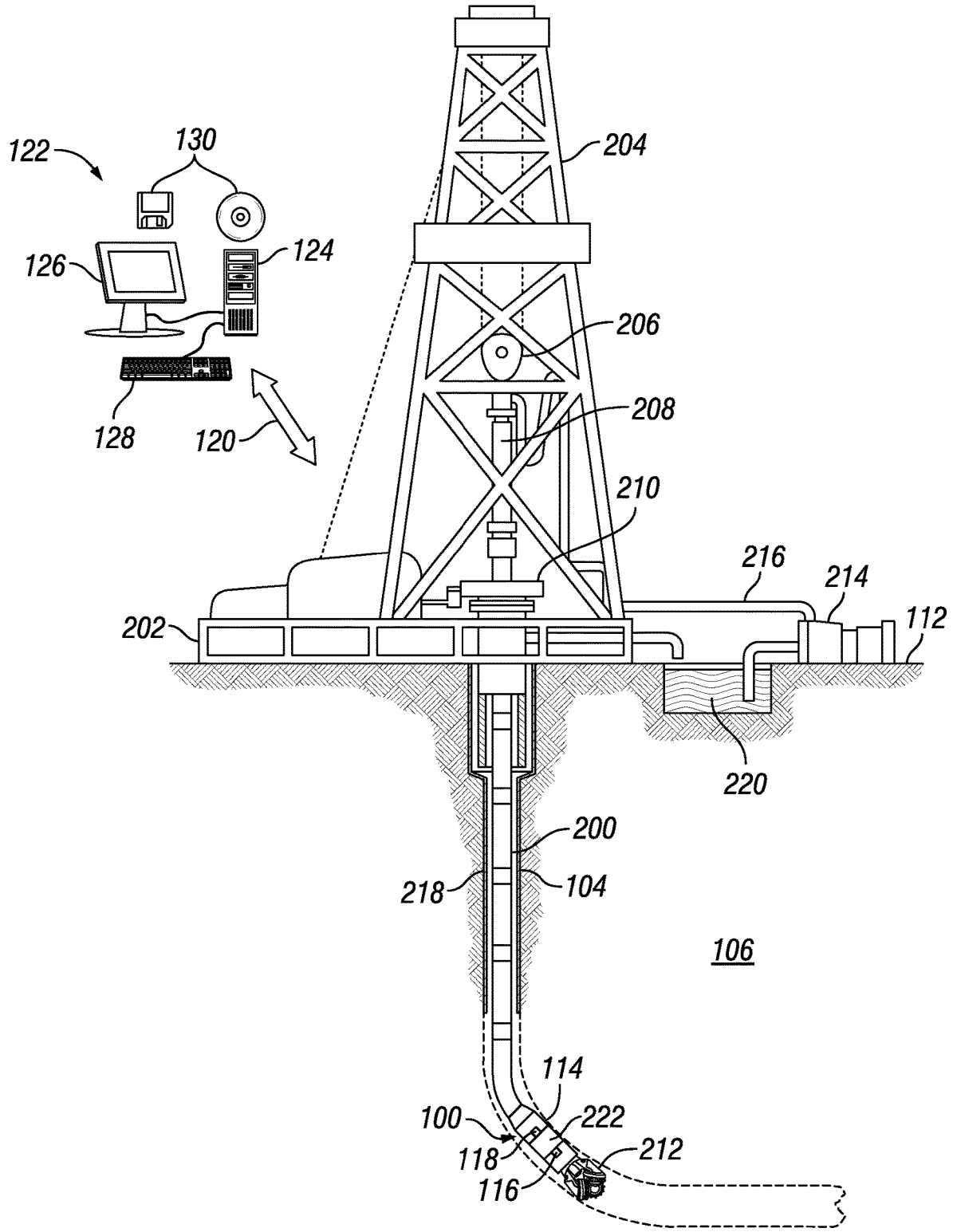
FIG. 2 is a schematic diagram of an example downhole fluid sampling tool on a drill string.

Referring now to FIG. 2, FIG. 2 is a schematic diagram is shown of downhole fluid sampling tool 100 disposed on a drill string 200 in a drilling operation. Downhole fluid sampling tool 100 may be used to obtain a fluid sample, for example, a fluid sample of a reservoir fluid from subterranean formation 106. The reservoir fluid may be contaminated with well fluid (e.g., drilling fluid) from wellbore 104. As described herein, the fluid sample may be analyzed to determine fluid contamination and other fluid properties of the reservoir fluid. As illustrated, a wellbore 104 may extend through subterranean formation 106. While the wellbore 104 is shown extending generally vertically into the subterranean formation 106, the principles described herein are also applicable to wellbores that extend at an angle through the subterranean formation 106, such as horizontal and slanted wellbores. For example, although FIG. 2 shows a vertical or low inclination angle well, high inclination angle or horizontal placement of the well and equipment is also possible. It should further be noted that while FIG. 2 generally depicts a land-based operation, those skilled in the art will readily recognize that the principles described herein are equally applicable to subsea operations that employ floating or sea-based platforms and rigs, without departing from the scope of the disclosure.

As illustrated, a drilling platform 202 may support a derrick 204 having a traveling block 206 for raising and lowering drill string 200. Drill string 200 may include, but is not limited to, drill pipe and coiled tubing, as generally known to those skilled in the art. A kelly 208 may support drill string 200 as it may be lowered through a rotary table 210. A drill bit 212 may be attached to the distal end of drill string 200 and may be driven either by a downhole motor and/or via rotation of drill string 200 from the surface 112. Without limitation, drill bit 212 may include, roller cone bits, PDC bits, natural diamond bits, any hole openers, reamers, coring bits, and the like. As drill bit 212 rotates, it may create and extend wellbore 104 that penetrates various subterranean formations 106. A pump 214 may circulate drilling fluid through a feed pipe 216 to kelly 208, downhole through interior of drill string 200, through orifices in drill bit 212, back to surface 112 via annulus 218 surrounding drill string 200, and into a retention pit 220.

Drill bit 212 may be just one piece of a downhole assembly that may include one or more drill collars 222 and downhole fluid sampling tool 100. Downhole fluid sampling tool 100, which may be built into the drill collars 22) may gather measurements and fluid samples as described herein. One or more of the drill collars 222 may form a tool body 114, which may be elongated as shown on FIG. 2. Tool body 114 may be any suitable material, including without limitation titanium, stainless steel, alloys, plastic, combinations thereof, and the like. Downhole fluid sampling tool 100 may be similar in configuration and operation to downhole fluid sampling tool 100 shown on FIG. 1 except that FIG. 2 shows downhole fluid sampling tool 100 disposed on drill string 200. Alternatively the sampling tool may be lowered into the wellbore after drilling operations on a wireline.

Downhole fluid sampling tool 100 may further include one or more sensors 116 for measuring properties of the fluid sample reservoir fluid, wellbore 104, subterranean formation 106, or the like. The properties of the fluid are measured as the fluid passes from the formation through the tool and into either the wellbore or a sample container. As fluid is flushed in the near wellbore region by the mechanical pump, the fluid that passes through the tool generally reduces in drilling fluid filtrate content, and generally increases in formation fluid content. The downhole fluid sampling tool 100 may be used to collect a fluid sample from subterranean formation 106 when the filtrate content has been determined to be sufficiently low. Sufficiently low depends on the purpose of sampling. For some laboratory testing below 10% drilling fluid contamination is sufficiently low, and for other testing below 1% drilling fluid filtrate contamination is sufficiently low. Sufficiently low also depends on the nature of the formation fluid such that lower requirements are generally needed, the lighter the oil as designated with either a higher GOR or a higher API gravity. Sufficiently low also depends on the rate of cleanup in a cost benefit analysis since longer pumpout times required to incrementally reduce the contamination levels may have prohibitively large costs. As previously described, the fluid sample may comprise a reservoir fluid, which may be contaminated with a drilling fluid or drilling fluid filtrate. Downhole fluid sampling tool 100 may obtain and separately store different fluid samples from subterranean formation 106 with fluid analysis module 118. Fluid analysis module 118 may operate and function in the same manner as described above. However, storing of the fluid samples in the downhole fluid sampling tool 100 may be based on the determination of the fluid contamination. For example, if the fluid contamination exceeds a tolerance, then the fluid sample may not be stored. If the fluid contamination is within a tolerance, then the fluid sample may be stored in the downhole fluid sampling tool 100.

As previously described, information from downhole fluid sampling tool 100 may be transmitted to an information handling system 122, which may be located at surface 112. As illustrated, communication link 120 (which may be wired or wireless, for example) may be provided that may transmit data from downhole fluid sampling tool 100 to an information handling system 111 at surface 112. Information handling system 140 may include a processing unit 124, a monitor 126, an input device 128 (e.g., keyboard, mouse, etc.), and/or computer media 130 (e.g., optical disks, magnetic disks) that may store code representative of the methods described herein. In addition to, or in place of processing at surface 112, processing may occur downhole (e.g., fluid analysis module 118). In examples, information handling system 122 may perform computations to estimate clean fluid composition.

Figure 3:
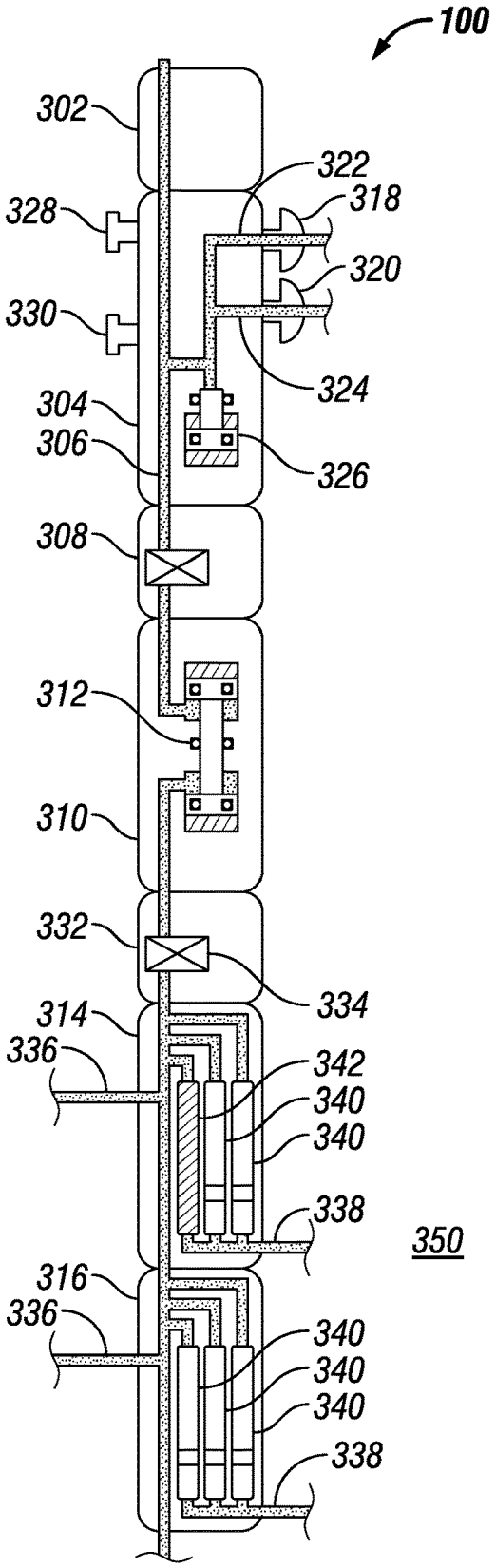
FIG. 3 is a schematic diagram of a downhole fluid sampling tool with a filter disposed in a chamber.

FIG. 3 is a schematic of downhole fluid sampling tool 100. In examples one embodiment, the downhole fluid sampling tool 100 includes a power telemetry section 302 through which the tool communicates with other actuators and sensors 116 in drill string 200 or conveyance 102 (e.g., referring to FIGS. 1 and 2), the drill string's telemetry section 302, and/or directly with a surface telemetry system (not illustrated). In examples, power telemetry section 302 may also be a port through which the various actuators (e.g. valves) and sensors (e.g., temperature and pressure sensors) in the downhole fluid sampling tool 100 may be controlled and monitored. In examples, power telemetry section 302 includes a computer that exercises the control and monitoring function. In one embodiment, the control and monitoring function is performed by a computer in another part of the drill string or wireline tool (not shown) or by information handling system 122 on surface 112 (e.g., referring to FIGS. 1 and 2).

In examples, downhole fluid sampling tool 100 includes a dual probe section 304, which extracts fluid from the reservoir and delivers it to a channel 306 that extends from one end of downhole fluid sampling tool 100 to the other. Without limitation, dual probe section 304 includes two probes 318, 320 which may extend from downhole fluid sampling tool 100 and press against the inner wall of wellbore 104 (e.g., referring to FIG. 1). Probe channels 322, 324 may connect probes 318, 320 to channel 306. The high-volume bidirectional pump 312 may be used to pump fluids from the reservoir, through probe channels 322, 324 and to channel 306. Alternatively, a low volume pump 326 may be used for this purpose. Two standoffs or stabilizers 328, 330 hold downhole fluid sampling tool 100 in place as probes 318, 320 press against the wall of wellbore 104. In examples, probes 318, 320 and stabilizers 328, 330 may be retracted when downhole fluid sampling tool 100 may be in motion and probes 318, 320 and stabilizers 328, 330 may be extended to sample the formation fluids at any suitable location in wellbore 104. Other probe sections include focused sampling probes, oval probes, or packers.

In examples, channel 306 may be connected to other tools disposed on drill string 200 or conveyance 102 (e.g., referring to FIGS. 1 and 2). In examples, downhole fluid sampling tool 100 may also include a quartz gauge section 308, which may include sensors to allow measurement of properties, such as temperature and pressure, of fluid in channel 306. Additionally, downhole fluid sampling tool 100 may include a flow-control pump-out section 310, which may include a high-volume bidirectional pump 312 for pumping fluid through channel 306. In examples, downhole fluid sampling tool 100 may include two multi-chamber sections 314, 316, referred to collectively as multi-chamber sections 314, 316 or individually as first multi-chamber section 314 and second multi-chamber section 316, respectively.

In examples, multi-chamber sections 314, 316 may be separated from flow-control pump-out section 310 by sensor section 332, which may house at least one sensor 334. Sensor 334 may be displaced within sensor section 332 in-line with channel 306 to be a "flow through" sensor. In alternate examples, sensor 334 may be connected to channel 306 via an offshoot of channel 306. Without limitation, sensor 334 may include optical sensors, acoustic sensors, electromagnetic sensors, conductivity sensors, resistivity sensors, selective electrodes, density sensors, mass sensors, thermal sensors, chromatography sensors, viscosity sensors, bubble point sensors, fluid compressibility sensors, flow rate sensors, microfluidic sensors, selective electrodes such as ion selective electrodes, and/or combinations thereof. In examples, sensor 334 may operate and/or function to measure drilling fluid filtrate, discussed further below.

Figure 4:
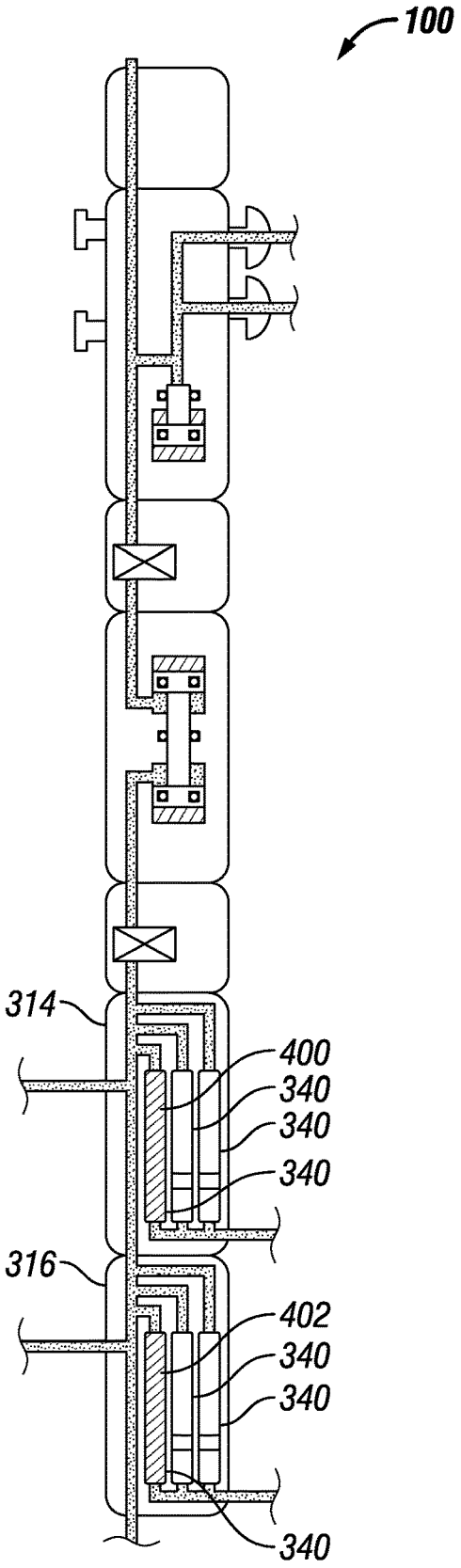
FIG. 4 is a schematic diagram of a plurality of multiple filters disposed in the downhole fluid sampling tool.

Additionally, multi-chamber section 314, 316 may comprise access channel 336 and chamber access channel 338. Without limitation, access channel 336 and chamber access channel 338 may operate and function to either allow a solids-containing fluid (e.g., mud) disposed in wellbore 104 in or provide a path for removing fluid from downhole fluid sampling tool 100 into wellbore 104. As illustrated, multi-chamber section 314, 316 may comprise a plurality of chambers 340. Chambers 340 may be sampling chamber that may be used to sample wellbore fluids, formation fluids, and/or the like during measurement operations. As illustrated in FIG. 3, in examples, at least one chamber 340, may be a filter 342. Filter 342 may be disposed in any chamber 340 and is not limited to the illustration in FIG. 3. Additionally, there may be any number of filters 342 disposed in any number of multi-chamber sections 314, 316. For example, as illustrated in FIG. 4, a first filter 400 may be disposed in a first multi-chamber section 314 and a second filter 402 may be disposed in a second multi-chamber section 316. Without limitation, any number of filters may be disposed in any number of chambers 340.

Alternatively, filter 342 may be constructed as a separate entity in the form of chamber 340. The exemplary filter 342, not conforming to the form of chamber 340, may be located outside multi-chamber sections 314, 316 in communication with channel 306. A separate chamber section (e.g., first multi-chamber section 314), as one embodiment, may have channel 306 comprising a dual line, one to the wellbore as an exit flow line and a through flow line to join the channel 306 along the downhole fluid sampling tool 100. The split may further benefit from at least one switching valve, two switching valves to operate in tandem, or a three way switching valve. In addition to the through flow line and the exit flow line, the stand-alone filter 342 may contain an inlet flow line to join the through flow line, with an isolation valve between filter 342 and the through flow line.

In examples, filter 342 may be a grading mesh, sand pack, gravel pack, and/or combination therein which may capture filtrate without plugging channel 306. Without limitation filter 342 may comprise any number of layers and may be able to remove large particulates and fine particulates. For example, a screen filters the greatest number of particles at the inlet. In one arrangement, the screen may capture the largest particles proximate to the inlet from the wellbore and may capture the smallest particles proximate to the channel 306. Successively finer filters may be disposed in an arrangement to remove solids without plugging the arrangement. In examples, a conical structure may be used to enhance the surface area for filtration.

In examples, filter 342 may have a bypass (not illustrated) in-order to mitigate plugging. In examples, a vortex centrifuge (not illustrated) may be disposed in filter 342 and may be used to reduce the solid load prior to filtering. Additionally, filter 342 may be pre-loaded with flocculants at any level of filtration. In examples, flocculants may be disposed in a container (not illustrated) and added to filter 342 by any suitable means. For example, flocculants may be added based at least in part from opening a valve (not illustrated) and releasing the flocculants or an operator may send commands to a valve to release the flocculants. Flocculation agents may be used to aid filtering action by taking finer particles and sticking them together in order to create bigger particles that may be more effectively captured by filtration. During operations flocculation agents may have known sensor response, which may be utilized during processing of measurements taken by downhole fluid sampling tool 100 in order to determine a flocculent free sensor reading of filtrate. Sensor readings of the flocculants may help the control mechanism for the release of flocculants. Flocculants may operate with fine particles to agglomerate the fine particles into larger particles, which may be captured by filter 342. Flocculants may remove clay particles from water, and may be present within about 1-10,000 PPM, which may not affect the bulk properties of fluid traversing through filter 342. Flocculent concentrations may be dependent on various properties of the fluid, the solid to be flocculated, temperature, pressure of the system, and/or combinations thereof. Polymer flocculants may be present in as low as 1 ppm concentration to induce flocculation in clay particles, however, the concentration of the flocculent relative to the concentration of the material to flocculate may also be considered. In examples, concentrations of 20 ppm flocculent to solid may be required to effectively flocculate particles. The flocculation requirements may be the greater of either 1 ppm concentration in solution, or 20 ppm relative concentration to the solid content. Therefore, a reduced requirement of concentration may be derived by injecting the flocculent directly into filter 342 for which the flocculation must occur in order to decrease the solid content from particles above the size of filter 342. It may be understood herein that as flocculants are developed, lower concentrations may be required to achieve the same effects. It should also be understood herein that larger concentrations of flocculants may be used to induce more rapid flocculation.

Figure 5:
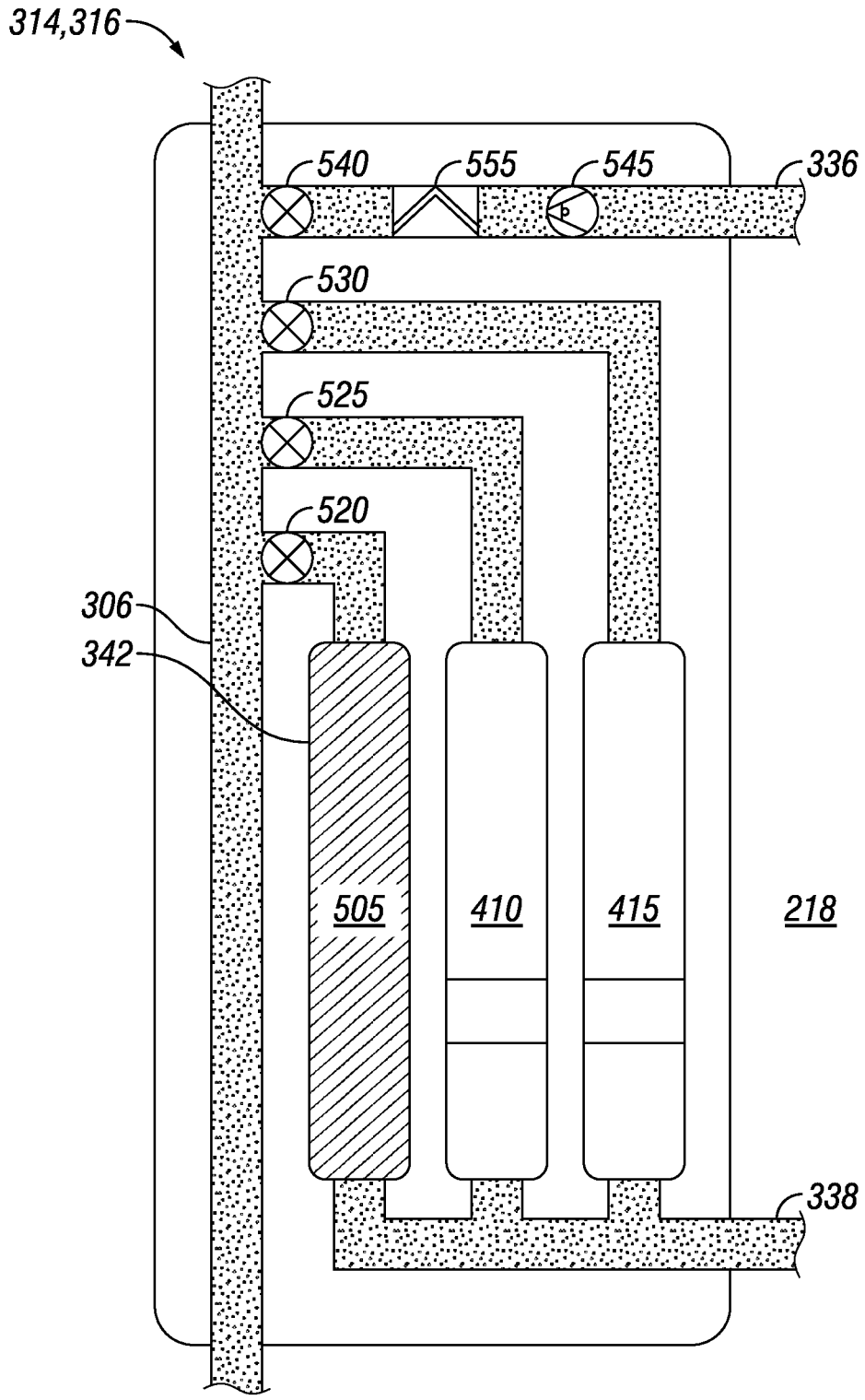
FIG. 5 is a schematic diagram of a multi-chamber section with a filter.

FIG. 5 illustrates a magnified view of multi-chamber sections 314, 316 may include a first chamber 505, a second chamber 510, and a third chamber 515 (referred to collectively as sample chambers 505, 510, 515). While FIG. 5 shows multi-chamber sections 314, 316 having three sample chambers 505, 510, 515, it should be understood that multi-chamber sections 314, 316 may have any number of sample chambers. It should be noted that first multi-chamber section 314 may have a different number of sample chambers than second multi-chamber section 316. As discussed above, a filter 342 may be disposed in any of sample chambers 505, 510, or 515. As illustrated in FIG. 5, filter 342 is disposed in first chamber 505.

In an example, the sample chambers 505, 510, 515 may be coupled to channel 306 through respective chamber valves 520, 525, 530, referred to separately as first chamber valve 520, second chamber valve 525, and third chamber valve 530. Additionally, reservoir fluid may be directed from channel 306 to a selected sample chamber by opening the appropriate chamber valve. For example, reservoir fluid may be directed from channel 306 to first chamber 505 by opening first chamber valve 520, reservoir fluid may be directed from channel 306 to second chamber 510 by opening second chamber valve 525, and reservoir fluid may be directed from channel 306 to third chamber 515 by opening third chamber valve 530. Additionally, when one chamber valve is open the others may be closed.

Without limitation, multi-chamber sections 314, 316 include access channel 336 from channel 306 to the annulus 218 through a valve 540. Valve 540 may be open during the draw-down period when Downhole fluid sampling tool 100 may be clearing mud cake, drilling mud, and other contaminants into annulus 218 before clean formation fluid is directed to one of the sample chambers 505, 510, 515. A check valve 545 may prevent fluids from annulus 218 from flowing back into channel 306 through path 336. In examples, multi-chamber sections 314, 316 include chamber access channel 338 from sample chambers 505, 510, 515 to annulus 218.

Referring back to FIG. 3, during measurement operations, it may be beneficial to determine drilling fluid filtrate before and/or after a pumpout. A pumpout may be an operation where at least a portion of a solids-containing fluid (e.g., drilling fluid, mud, etc.) may move through downhole fluid sampling tool 100 until substantially increasing concentrations of formation fluids enter downhole fluid sampling tool 100. However, before pumpout, it may be beneficial to measure drilling fluid filtrate with sensor section 332 utilizing sensor 334. To perform this operation, high-volume bidirectional pump 312 may pull drilling fluid 350 from wellbore 104 (e.g., referring to FIG. 1) into downhole fluid sampling tool 100. For this operation, chamber valve 520 (e.g., referring to FIG. 3) may be open, which may allow high-volume bidirectional pump 312 to draw drilling fluid 350 through chamber access channel 338. Drilling fluid 350 may traverse through chamber access channel 338 to filter 342. Drilling fluid 350 may move across filter 342 and filter 342 may remove particulate manner in drilling fluid 350. As drilling fluid 350 traverses through filter 342 it may become drilling fluid filtrate. The drilling fluid filtrate may pass through first chamber valve 520 and into channel 306 toward high-volume bidirectional pump 312. As the drilling fluid filtrate moves toward high-volume bidirectional pump 312, the drilling fluid filtrate may move into sensor section 332. Once the drilling fluid filtrate has moved into sensor section 332 high-volume bidirectional pump 312 may stop. This may allow the drilling fluid filtrate to be measured by sensor 334 within sensor section 332. Without limitation, any suitable properties of the drilling fluid filtrate may be measured. These measurements may allow an operator to calibrate sensor 334 for quality control. In examples, these measurements may be used to constrain the sensor signatures during contamination, normalize measurements of two or more sensors 334, and or correlate two or more dissimilar sensors 334.

As an example embodiment, the concentration of drilling fluid filtrate within the fluid being pumped from subterranean formation 106 (e.g., referring to FIGS. 1 and 2) may be calculated below as:

$$\text{contamination } \% = (\text{reading}_{filtrate} - \text{reading}_{flow})/(\text{reading}_{filtrate} - \text{reading}_{formation\ fluid}) * 100 \quad \text{(Eq. 1)}$$

The units of the drilling fluid filtrate may depend on the fundamental physics of sensor 334 and as to whether sensor 334 may be sensitive innately to volume and/or mass yielding either a volume percent or mass percent. Mass percent and volume percent may be interchanged with knowledge of the density of the fluids. In examples, formation fluid reading may be estimated by an asymptotic fit to the sensor readings as the fluid being withdrawn from subterranean formation 106 grades from filtrate to formation fluid. Without limitations, other suitable methods to calculate contamination may include multivariate curve resolution, equation of state, pattern recognition, direct contamination measurement, and/or combinations thereof. All contamination determination methods may benefit from a better estimate or measurement of pure filtrate sensor readings.

In examples, a sufficiently high concentration of filtered wellbore fluid may be moved across sensor 334 to make a sensor reading as a proxy for drilling fluid filtrate contained in a region near wellbore 104. The sufficiently clean wellbore fluid may be greater than 85% filtered wellbore fluid. The 100% pure filtrate estimate may be made by fitting the sensor reading as a function of time and/or equivalent dependent variable such as to volume pumped, by a sufficient asymptote as to describe the effect of sensor reading as a function of time. More preferably, the wellbore fluid may be pumped and filtered in order to derive a greater than 95% clean estimate. If the wellbore fluid is pumped sufficiently as to completely flush channel 306 with filtered wellbore fluid, a pure filtrate may be directly measured. Once measurements have been made, first chamber valve 520 (e.g., referring to FIG. 3) may be closed and valve 540 (e.g., referring to FIG. 3) for access channel 336 may be open. Bidirectional pump 312 may switch pumping direction and force the drilling fluid filtrate through valve 540, through access channel 336, and into wellbore 104 (e.g., referring to FIG. 1). This may prepare downhole fluid sampling tool 100 for sampling operations. During expelling of the filtered wellbore fluid, the fluid may be diverted into a subsequent chamber 340 in order to bring a filtered wellbore fluid to surface 112 (e.g., referring to FIGS. 1 and 2).

Figure 6:
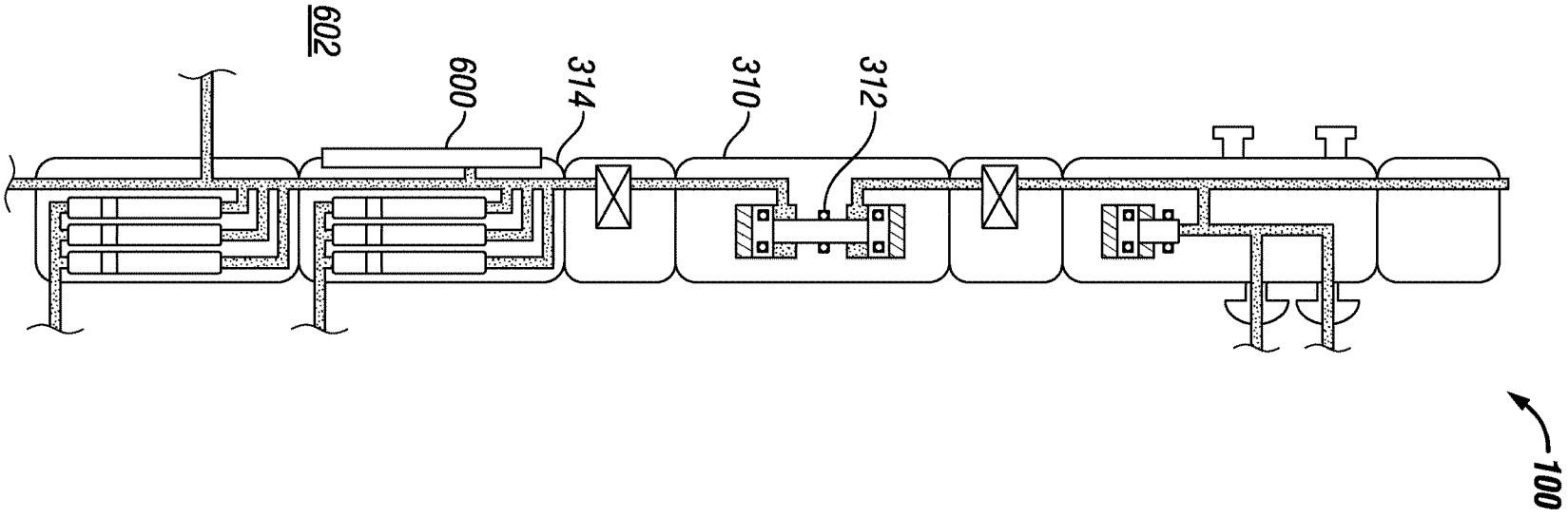
FIG. 6 is another example of schematic diagram of a downhole fluid sampling tool with a filter disposed in a chamber.
Figure 7:
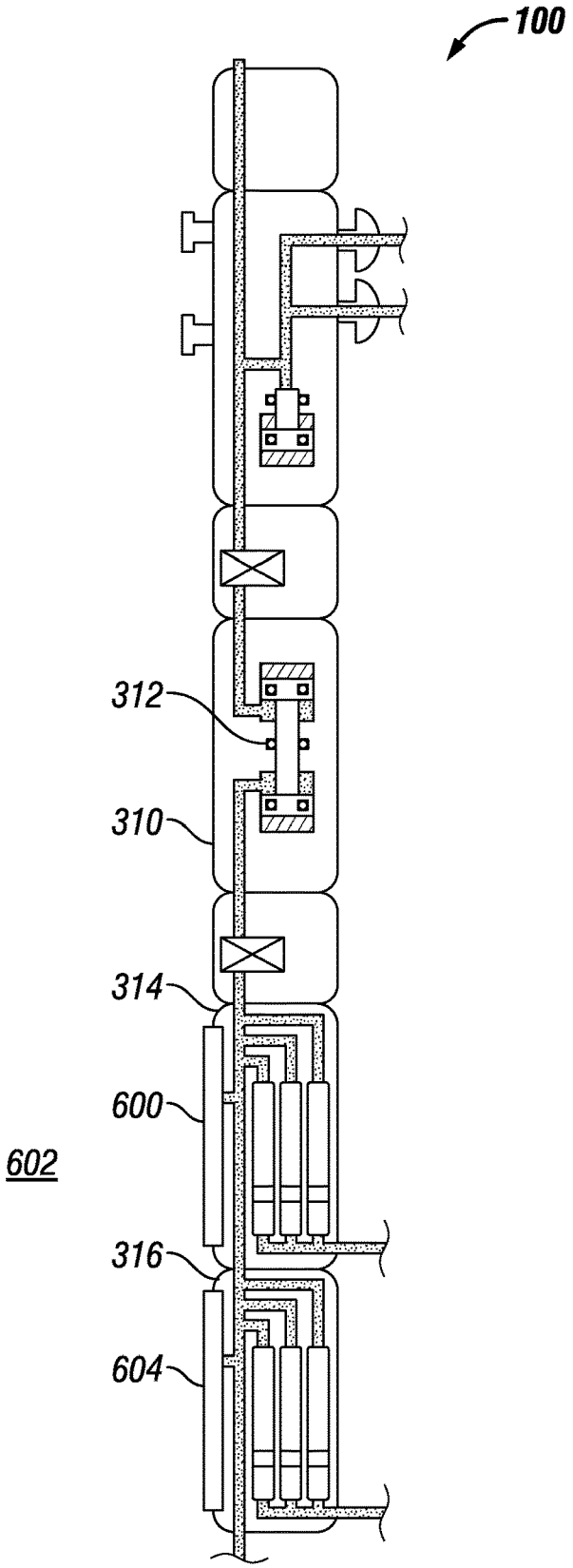
FIG. 7 is another example of schematic diagram of a downhole fluid sampling tool with a plurality of filters disposed in a chamber.

FIG. 6 illustrates another example of downhole fluid sampling tool 100 which may include filter 600. During operations, downhole fluid sampling tool 100 may sample solids-containing fluid 602 which may be disposed in wellbore 104 (e.g., referring to FIG. 1). As illustrated a filter 600 may be disposed on the outer housing of first multi-chamber section 314. Without limitation, multiple filter sets may be disposed together, in series, and/or in parallel to generate clean filtrate at one or more stations. For example, referring to FIG. 7, a first filter 600 may be disposed in first multi-chamber section 314 and a second filter 604 may be disposed in second multi-chamber 316. Referring back to FIG. 6, filter 600 may be pleated to increase the amount of filtrate captured. Filtrate may be defined as the soluble parts of solids-containing fluid 602 and oil which may have comingled during drilling operations. Filtrate may be formed from solids-containing fluid 602 passing through filters 600. During operations, high-volume bidirectional pump 312 may pull solids-containing fluid 602 from wellbore 104 through filter 600 into downhole fluid sampling tool 100. Filtrate may form a "filter cake" on the surface of filter 600 exposed to solids-containing fluid 602 in wellbore 104. In examples, high-volume bidirectional pump may operate to produce a back flow, where fluid inside of downhole fluid sampling tool 100 may traverse across filter 600 to wellbore 104. The flow of fluid outward may loosen the filter cake. Loosening the filter cake and moving downhole fluid sampling tool 100 may cause the filter cake to dislodge from filter 600. This operation may be helped by solids-containing fluid 602, which may be moving in a cross flow pattern. Removing the filter cake may allow for an operator to "clean" filter 600 while downhole fluid sampling tool 100 may be disposed in wellbore 104.

Figure 8:
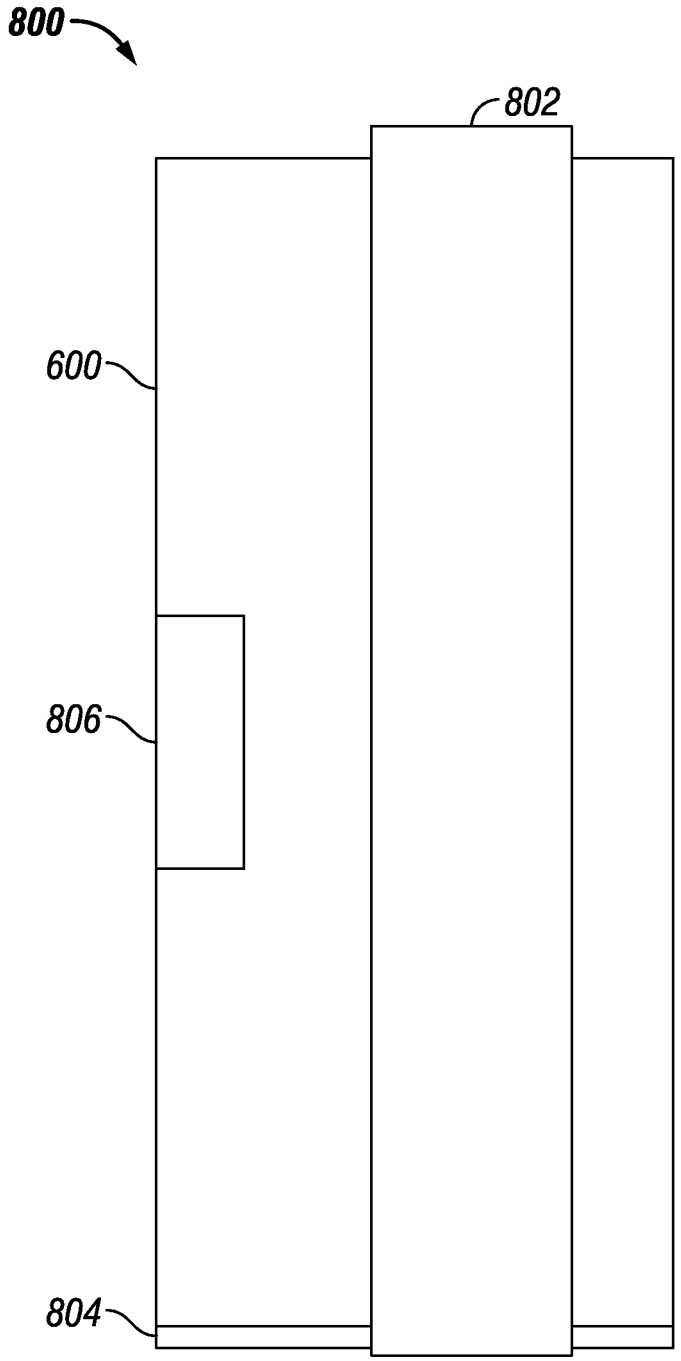
FIG. 8 is an example of a cartridge.

FIG. 8 illustrates cartridge 800, which may include filter 600 and attachment device 802. In examples, filter 600 may be a grading mesh, which may capture filtrate without plugging a channel 306 (e.g., referring to FIG. 6). Without limitation filter 600 may comprise any number of layers and may be able to remove large particulates and fine particulates. For example, a screen filters the greatest number of particles at the inlet. Successively finer filters may be disposed in an arrangement to remove solids without plugging the arrangement. In examples, a conical structure may be used to enhance the surface area for filtration.

In examples, cartridge 800 may attach to downhole fluid sampling tool 100 (e.g., referring to FIG. 6) through attachment device 802. Without limitation, attachment device may be a press fitting, tab connector, nuts and bolts, threaded pipe and/or the like. Each cartridge 800 may have a bypass 804 in-order to mitigate plugging. In examples, vortex centrifuge 806 may be used to reduce the solid load prior to filtering. Without limitation, cartridge 800 may not be used to transport fluids and may act as a structural support for filter 600 during operations. In examples, filter 600 may be pre-loaded with flocculants at any level of filtration within cartridge 800. In examples, flocculants may be disposed in a container (not illustrated) and added to filter 600 by any suitable means. For example, flocculants may be added based at least in part from sensors opening a valve (not illustrated) and releasing the flocculants or an operator may send commands to a valve to release the flocculants. Flocculation agents may be used to aid analysis. During operations flocculation agents may have known sensor response, which may be utilized during processing of measurements taken by downhole fluid sampling tool 100. Flocculants may operate with fine particles to agglomerate the fine particles into larger particles, which may be captured by filter 600. Flocculants may remove clay particles from water, and may be present within PPM concentrations which may not affect the bulk properties of fluid traversing through filter 600. Flocculent concentrations may be dependent on various properties of the fluid, the solid to be flocculated, temperature, pressure of the system, and/or combinations thereof. Polymer flocculants may be present in as low as 1 ppm concentration to induce flocculation in clay particles, however, the concentration of the flocculent relative to the concentration of the material to flocculate may also be considered. For instance, concentrations of 20 ppm flocculent to solid may be required to effectively flocculate particles. The flocculation requirements, in this case, may be the greater of either 1 ppm concentration in solution, or 20 ppm relative concentration to the solid content. Therefore, a reduced requirement of concentration may be derived by injecting the flocculent directly into filter 342 (e.g., referring to FIG. 3) for which the flocculation must occur in order to decrease the solid content from particles above the size of filter 342. It may be understood herein that as flocculants are developed, lower concentrations may be required to achieve the same effects. It should also be understood herein that larger concentrations of flocculants may be used to induce more rapid flocculation.

Figure 9:
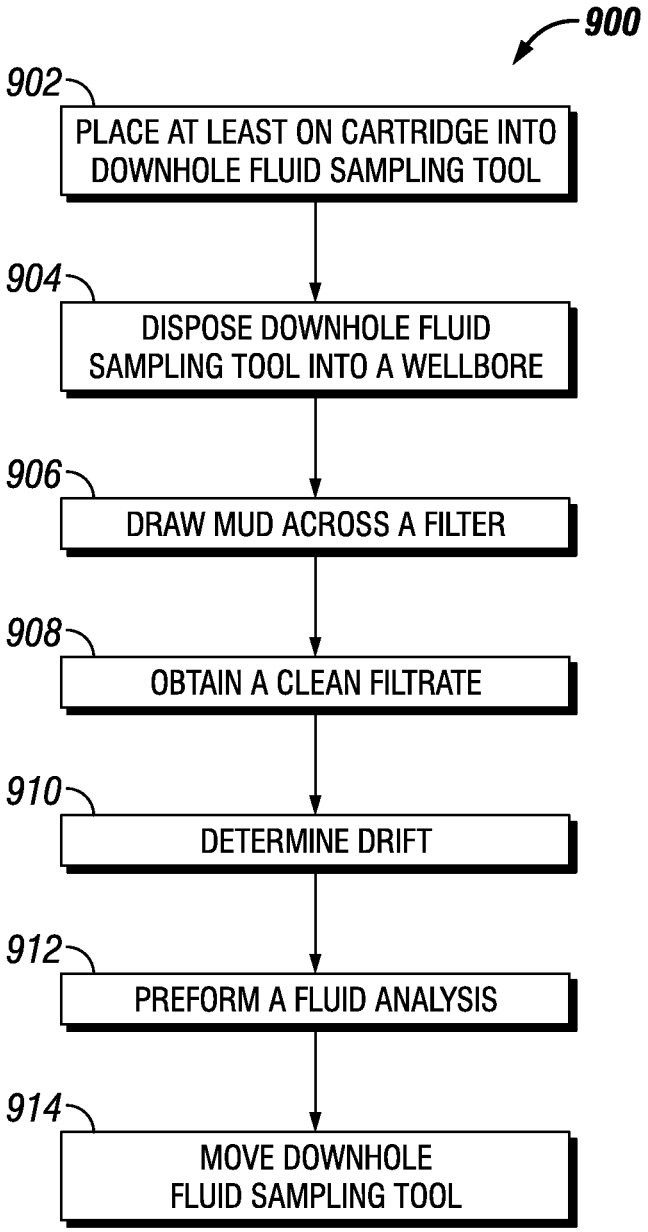
FIG. 9 is a workflow to determine contamination of a wellbore fluid.

FIG. 9 illustrates a workflow 900 to determine contamination of a wellbore fluid. Workflow 900 may begin with step 902. In step 902 an operator may place at least one cartridge 800 (e.g., referring to FIG. 8) into downhole fluid sampling tool 100. In example, any number of cartridges 800 (or filters 342, referring to FIGS. 3-5) may be disposed in downhole fluid sampling tool 100. Additionally, a flow line disposed in downhole fluid sampling tool 100 may be filled with air before being dispose downhole in measurement operations. In step 904 to operator may dispose downhole fluid sampling tool 100 into wellbore 104 (e.g., referring to FIG. 1) and move downhole fluid sampling tool 100 to a first location. At the first location the operator may perform a first formation pumpout. In step 906, before a pumpout may begin, solids-containing fluid 602 may be drawn across filter 600 into downhole fluid sampling tool 100 to form filtrate. The mere pressure differential between wellbore 104 and the flow line disposed in downhole fluid sampling tool 100 may allow for solids-containing fluid 602 to move across filter 600. In examples, a high-volume bidirectional pump 312 (e.g., referring to FIG. 6) may be used to drawn solids-containing fluid 602 across filter 600 into downhole fluid sampling tool 100. Fluid that passes through filter 600 may be displaced through the downhole fluid sampling tool 100 and measurements may be performed on the sample by any suitable means, such as optical measurements.

In step 908 a clean filtrate may be obtained at the first location. A clean filtrate signal may be obtained before and or after a pumpout. Clean filtrate measurements may be used to constrain the sensor signatures for quality, which may be used to normalize the signals of two or more identical sensors and/or to correlate two or more dissimilar sensors. This may be a form of quality control for the sensors before and after a pumpout. In step 910 drift may be determined. Drift may be a sensor reading change over time for a standard reference. Drift may be related to temperature, pressure changes, or any other time induced changes. By making sensor readings before and after a pumpout, the sensor readings as a function of time may be defined, but not limited to, linearly extrapolating the sensor reading across the pumpout time. For example, before and after pumpout may be used to normalize one or more sensors with respect to drift during a pumpout. This drift may be measured with respect to time, temperature or pressure, and corrected as such during the pumpout. Additionally, different station filtrate measurements, at different depths and/or positions within a wellbore, may also be used for drift normalization.

In step 912, fluid analysis may be performed. Fluid analysis may be used for sensor quality control and to normalize any number of sensors within downhole fluid sampling tool 100. It should be noted that during fluid analysis micro-addition of flocculation agents may be used to aid filtering and/or centrifuging. Correlation of sensors such as optical sensors, acoustic sensors, electromagnetic sensors, conductivity sensors, resistivity sensors, selective electrodes, density sensors, mass sensors, thermal sensors, chromatography sensors, viscosity sensors, bubble point sensors, fluid compressibility sensors, flow rate sensors, microfluidic sensors, selective electrode such as ion selective electrodes, or combinations thereof, among each other may provide a bridge during pumpout sampling such that if the filtrate may not be sufficiently free of particles, a filtrate reading estimation may be made. For instance, density may be correlated to optical measurements in order to determine a particle free optical estimate of the sensor reading, wherein density is affected by trace particles and optical measurements may be more affected by particles. This may be applied similarly for other sensors in channel 306 (e.g., referring to FIG. 3). In examples, optical sensors may be calibrated to density to determine clean filtrate optical properties.

In step 914 downhole fluid sampling tool 100 may be moved to a second station and the measurements describe above may be repeated. Measurements from two stations may be used with extrapolation between stations to determine drift. If drift is negligible then a single station pumpout may be used as the reference for all stations. Negligible drift may be determined by the influence of the change in sensor reading upon the final cleanup value. Without limitations, it may be determined by Monte Carlo methods of introducing measurement perturbation to sensor readings to determine influence in a contamination determination model. Contamination models may include, but are not limited to, asymptotic contamination monitoring, multivariate curve resolution, equation of state, pattern recognition, direct contamination measurement, and/or combinations thereof. However, pressure and temperature differences may be more accurately taken into account for drift normalization by use of data from multiple stations. At different stations (or before and after a single pumpout), the same cartridges 600 may be used, or downhole fluid sampling tool 100 may be used to switch between cartridge assemblies.

In examples, a pure filtrate may be placed in the channel 306 (e.g., referring to FIG. 3) of the downhole fluid sampling tool 100 at surface 112 (e.g., referring to FIGS. 1 and 2). The temperature pressure reading of the filtrate may be used to estimate drift, or directly used, if drift is determined to be negligible. The surface filtrate may be obtained at the mud pit as opposed to wellbore 104 (e.g., referring to FIG. 1). The fluid may be filtered at surface 112 by a mechanism separate from the downhole fluid sampling tool 100, or centrifuged in a device separate from downhole fluid sampling tool 100.

Current methods of contamination monitoring may use the filtrate signature during a formation pumpout using downhole fluid sampling tool 100 in order to determine sensor reading estimates on pure filtrate. Unfortunately, the transient of pure formation fluid may be either short lived or nonexistent. Further, formation particles may exist in channel 306 (e.g., referring to FIG. 3) which may prohibit a good sensor reading until the concentration of drilling fluid filtrate is prohibitively low for a high quality estimation of the pure drilling fluid filtrate reading. In examples, the high concentration filtrate sample may exist for about a few minutes or less. Further, the particle cleanup may take, without limitations, about ten to twenty minutes. Concentrations of drilling fluid filtrate in the fluid being pumped may be as low as 40% or less by the time particles clean up. This may make extrapolation to 100% pure drilling fluid filtrate difficult. Supposing that particles do clean up more rapidly in limited situations, and that pure drilling fluid filtrate is sustained from subterranean formation 106 (e.g., referring to FIGS. 1 and 2), for a longer period of time than a minute, the length of channel 306 between downhole fluid sampling tool 100 and sensors 334 (e.g., referring to FIG. 3) may be large. Sensors 334 may be located proximate to chambers 340 (e.g., referring to FIG. 3), which may be near the last sections in downhole fluid sampling tool 100 before fluid exits to wellbore 104 (e.g., referring to FIG. 1). Without limitations, downhole fluid sampling tool 100 may be multiple hundreds of feet long, and as such, a significant volume of channel 306 may exist between sensor 334 and probes 318, 320 (e.g., referring to FIG. 3). The formation fluid therefore may dilute with the fluid that is already in channel 306 before pumping from subterranean formation 106. This fluid may be a fluid placed in channel 306 at surface 112, solids-containing fluid from wellbore 104, or the last formation fluid pumped. For these reasons, it may be difficult to get an accurate sensor estimate of the drilling fluid filtrate. The current method may create a new drilling fluid filtrate from the wellbore fluid. The wellbore fluid may be the source of the drilling fluid filtrate in the near subterranean formation 106, and therefore may be a good proxy of the wellbore drilling fluid filtrate. Also, the current method may introduce the filtered wellbore fluid as a proxy to the drilling fluid filtrate from chambers 340 such that the distance to sensors 334 is shorter. This may allow for less dilution of the filtrate before the sensor reading, such that the filtrate may be extrapolated from a value of higher than 40% concentration of drilling fluid filtrate, usually from as high as 85% drilling fluid filtrate concentration, and under some circumstances as high as better than 95% drilling fluid filtrate concentration. In addition, a large sufficient quantity of drilling fluid filtrate may be made on demand with filter 342 (e.g., referring to FIG. 3) set such that the drilling fluid filtrate can be flushed for a longer period of time through the shorter path to sensor 334 on the back side of downhole fluid sampling tool 100 in order to get an improved filtrate characterization. In examples, relying on formation fluid filtrate from subterranean formation 106 may prevent taking a measurement for drift characterization after a pumpout.

The preceding description provides various embodiments of systems and methods of use which may contain different method steps and alternative combinations of components. It should be understood that, although individual embodiments may be discussed herein, the present disclosure covers all combinations of the disclosed embodiments, including, without limitation, the different component combinations, method step combinations, and properties of the system.

Statement 1: A method for measuring drilling fluid filtrate may comprise disposing a downhole fluid sampling tool into a wellbore at a first location. The downhole fluid sampling tool may comprise at least one multi-chamber section; at least one sensor section, wherein at least one sensor is disposed in the at least one sensor section; at least one filter, wherein the at least one filter is disposed in the at least one multi-chamber section; and a channel, wherein the channel fluidly connects the at least one multi-chamber section to the at least one sensor section. The method may further comprise activating a pump to draw a solids-containing fluid disposed in the wellbore into the downhole fluid sampling tool; drawing the drilling fluid with the pump across the at least one filter to form a drilling fluid filtrate; drawing the drilling fluid filtrate with the pump through the channel to the at least one sensor section; and measuring the drilling fluid filtrate with the at least one sensor.

Statement 2: The method of statement 1, wherein the at least one multi-chamber section comprises a plurality of chambers and wherein the filter is disposed in at least one of the plurality of chambers.

Statement 3. The method of statements 1 or 2, wherein the filter is disposed in a cartridge, and wherein the filter comprises at least one mesh configured to remove large particulates or fine particulates.

Statement 4. The method of statement 3, wherein the cartridge further comprises an attachment device configured to attach the cartridge to the at least one multi-chamber section.

Statement 5. The method of any preceding statement, wherein the filter further comprises a vortex centrifuge configured to reduce particulates from the drilling fluid before filtering the drilling fluid through the filter.

Statement 6. The method of any preceding statement, wherein the multi-chamber section comprises a bypass around the filter.

Statement 7. The method of any preceding statement, wherein the filter further comprises a plurality of flocculants.

Statement 8. The method of any preceding statement, wherein the multi-chamber section further comprises a plurality of flocculants disposed in a container that is fluidly coupled to the filter through a valve.

Statement 9. The method of any preceding statement, further comprising moving the downhole fluid sampling tool to a second location and repeating the steps of activating the pump, drawing the drilling fluid, drawing the drilling fluid filtrate, and measuring the drilling fluid filtrate.

Statement 10. The method of any preceding statement, further comprising calibrating the at least one sensor at least partially with the measurements of the drilling fluid filtrate.

Statement 11. A system for taking a clean fluid composition may comprise a downhole fluid sampling tool. The downhole fluid sampling tool may comprise at least one multi-chamber section; at least one sensor section, wherein at least one sensor is disposed in the at least one sensor section; at least one filter, wherein the at least one filter is disposed in the at least one multi-chamber section; a pump; and a channel, wherein the channel fluidly connects the at least one multi-chamber section to the at least one sensor section.

Statement 12. The system of statement 11, wherein the at least one multi-chamber section comprises at plurality of chambers and wherein the filter is disposed in at least one of the plurality of chambers.

Statement 13. The system of statements 11 or 12, wherein the filter is disposed in a cartridge and wherein the filter comprises at least one mesh configured to remove large particulates or fine particulates.

Statement 14. The system of statement 13, wherein the cartridge is disposed in the at least on multi-chamber section.

Statement 15. The system of statement 14, wherein the cartridge further comprises an attachment device configured to attach the cartridge to the at least one multi-chamber section.

Statement 16. The system of statements 11 to 15, wherein the at least one filter comprises a vortex centrifuge configured to reduce particulates from a solids-containing fluid before filtering the solids-containing fluid through the filter.

Statement 17. The system of statements 11 to 16, wherein the multi-chamber section comprises a bypass around the filter.

Statement 18. The system of statements 11 to 17, wherein the at least one filter further comprises a plurality of flocculants disposed in the filter.

Statement 19. The system of statements 11 to 18, further comprising a container, wherein the container is disposed in the multi-chamber section and a plurality of flocculants disposed in the container.

Statement 20. The system of statements 11 to 19, further comprising at least one sensor, wherein the at least one sensor is configured to measure a drilling fluid filtrate.

It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

Therefore, the present embodiments are well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Although individual embodiments are discussed, the invention covers all combinations of all those embodiments. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present invention. If there is any conflict in the usages of a word or term in this specification and one or more patent(s) or other documents that may be incorporated herein by reference, the definitions that are consistent with this specification should be adopted.

What is claimed is:

1. A method for measuring drilling fluid filtrate, comprising:

disposing a downhole fluid sampling tool into a wellbore at a first location, wherein the downhole fluid sampling tool comprises:

at least one multi-chamber section;

at least one sensor section, wherein at least one sensor is disposed in the at least one sensor section;

at least one filter, wherein the at least one filter is disposed in the at least one multi-chamber section; and a channel, wherein the channel fluidly connects the at least one multi-chamber section to the at least one sensor section; and activating a pump to draw a solids-containing fluid disposed in the wellbore into the downhole fluid sampling tool;

drawing a drilling fluid with the pump across the at least one filter to form a drilling fluid filtrate;

drawing the drilling fluid filtrate with the pump through the channel to the at least one sensor section; and measuring the drilling fluid filtrate with the at least one sensor.

2. The method of claim 1, wherein the at least one multi-chamber section comprises a plurality of chambers and wherein the filter is disposed in at least one of the plurality of chambers.

3. The method of claim 1, wherein the filter is disposed in a cartridge, and wherein the filter comprises at least one mesh configured to remove large particulates or fine particulates.

4. The method of claim 3, wherein the cartridge further comprises an attachment device configured to attach the cartridge to the at least one multi-chamber section.

5. The method of claim 1, wherein the filter further comprises a vortex centrifuge configured to reduce particulates from the drilling fluid before filtering the drilling fluid through the filter.

6. The method of claim 1, wherein the multi-chamber section comprises a bypass around the filter.

7. The method of claim 1, wherein the filter further comprises a plurality of flocculants.

8. The method of claim 1, wherein the multi-chamber section further comprises a plurality of flocculants disposed in a container that is fluidly coupled to the filter through a valve.

9. The method of claim 1, further comprising moving the downhole fluid sampling tool to a second location and repeating the steps of activating the pump, drawing the drilling fluid, drawing the drilling fluid filtrate, and measuring the drilling fluid filtrate.

10. The method of claim 1, further comprising calibrating the at least one sensor at least partially with the measurements of the drilling fluid filtrate.

11. A system for taking a clean fluid composition, comprising:

a downhole fluid sampling tool comprising:

at least one multi-chamber section;

at least one sensor section, wherein at least one sensor is disposed in the at least one sensor section;

at least one filter, wherein the at least one filter is disposed in the at least one multi-chamber section; and a pump configured to draw a drilling fluid across the at least one filter to form a drilling fluid filtrate and draw the drilling fluid filtrate through a channel to the at least one sensor wherein:

the channel fluidly connects the at least one multi-chamber section to the at least one sensor section; and the at least one sensor is configured to measure the drilling fluid filtrate.

12. The system of claim 11, wherein the at least one multi-chamber section comprises at plurality of chambers and wherein the filter is disposed in at least one of the plurality of chambers.

13. The system of claim 11, wherein the filter is disposed in a cartridge and wherein the filter comprises at least one mesh configured to remove large particulates or fine particulates.

14. The system of claim 13, wherein the cartridge is disposed in the at least one multi-chamber section.

15. The system of claim 14, wherein the cartridge further comprises an attachment device configured to attach the cartridge to the at least one multi-chamber section.

16. The system of claim 11, wherein the at least one filter comprises a vortex centrifuge configured to reduce particulates from a solids-containing fluid before filtering the solids-containing fluid through the filter.

17. The system of claim 11, wherein the multi-chamber section comprises a bypass around the filter.

18. The system of claim 11, wherein the at least one filter further comprises a plurality of flocculants disposed in the filter.

19. The system of claim 11, further comprising a container, wherein the container is disposed in the multi-chamber section and a plurality of flocculants disposed in the container.

20. The system of claim 11, wherein the at least one sensor is calibrated at least partially with the measurements of the drilling fluid filtrate.

* * * * *